US011383292B2

(12) United States Patent
Hugenschütt et al.

(10) Patent No.: US 11,383,292 B2
(45) Date of Patent: Jul. 12, 2022

(54) MOULD PLATE

(71) Applicant: KME Special Products GmbH & Co KG, Osnabrück (DE)

(72) Inventors: Gerhard Hugenschütt, Belm (DE); Thomas Rolf, Osnabrück (DE)

(73) Assignee: KME SPECIAL PRODUCTS & SOLUTIONS GMBH, Osnabrück (DE)

( * ) Notice: Subject to any disclaimer, the term of this patent is extended or adjusted under 35 U.S.C. 154(b) by 0 days.

(21) Appl. No.: 17/417,274

(22) PCT Filed: Jan. 8, 2020

(86) PCT No.: PCT/DE2020/100005
§ 371 (c)(1),
(2) Date: Jun. 22, 2021

(87) PCT Pub. No.: WO2020/156607
PCT Pub. Date: Aug. 6, 2020

(65) Prior Publication Data

US 2022/0143682 A1 May 12, 2022

(30) Foreign Application Priority Data

Jan. 30, 2019 (DE) ..... 10 2019 102 313.0

(51) Int. Cl.
*B22D 11/055* (2006.01)

(52) U.S. Cl.
CPC ..... *B22D 11/055* (2013.01)

(58) Field of Classification Search
CPC . B22D 11/055; B22D 11/124; B22D 11/1243; B22D 11/22
See application file for complete search history.

(56) References Cited

U.S. PATENT DOCUMENTS 6,874,564 B2 * 4/2005 Hugenschutt ..... B22D 11/055 164/443

FOREIGN PATENT DOCUMENTS

| | | |
|---|---|---|
| CN | 1322596 | 11/2001 |
| CN | 201168770 | 12/2008 |
| CN | 204997021 U | 1/2016 |
| DE | 102004001928 | 8/2005 |
| DE | 102016124801 | 12/2017 |
| DE | 102016124801 B3 | 12/2017 |
| JP | 2004074283 A | 3/2004 |

(Continued)

OTHER PUBLICATIONS

Chinese Search Report dated Nov. 19, 2021 with respect to counterpart Chinese patent application 20208000823061.

(Continued)

*Primary Examiner* — Kevin P Kerns
*Assistant Examiner* — Steven S Ha
(74) *Attorney, Agent, or Firm* — Henry M. Feiereisen LLC

(57) ABSTRACT

A mould plate includes a casting side and a rear side facing away from the casting side and having a cooling channel configured to open towards the rear side and having a cooling face opposite the casting side. An insert is arranged in the cooling channel to form a cooling gap between an inner face of the insert and the cooling face. A fastening bolt connects the insert to a fastening point in the cooling face, wherein the cooling gap extends, viewed from the fastening point towards the casting side, to an area below the fastening point.

13 Claims, 2 Drawing Sheets

(56) References Cited

FOREIGN PATENT DOCUMENTS

| | | | |
|---|---|---|---|
| JP | 2006-320925 | | 11/2006 |
| JP | 2006320925 | A | 11/2006 |
| JP | 2009006375 | A | 1/2009 |
| JP | 2009056490 | | 3/2009 |
| RU | 2106928 | | 3/1998 |

OTHER PUBLICATIONS

Translation of Chinese Search Report dated Nov. 19, 2021 with respect to counterpart Chinese patent application 20208000823061.
International Search Report issued by the European Patent Office dated Mar. 30, 2020 in International Application PCT/DE2020/100005.

* cited by examiner

MOULD PLATE

CROSS-REFERENCES TO RELATED APPLICATIONS

This application is the U.S. National Stage of International Application No. PCT/DE2020/100005, filed Jan. 8, 2020, which designated the United States and has been published as International Publication No, WO 2020/156607 A1 and which claims the priority of German Patent Application, Serial No, 10 2019 102 313.0, filed Jan. 30, 2019, pursuant to 35 U.S.C. 119(a)-(d).

BACKGROUND OF THE INVENTION

The invention concerns a mould plate.

The heat load on copper moulds in continuous strand casting may lead to considerable material stresses within the copper alloy, in particular in thin slab continuous casting plants. Mould plates are subjected to extreme heat loads on their hot side facing the melt, i.e. the casting side, while the rear side facing the cooling water remains largely cold. Within the mould plate, which is a few millimeters thick, a temperature gradient of several 100 degrees Kelvin occurs between the hot side and the water-cooled rear side. This leads to different thermal expansions in the thickness profile from the casting side to the rear side. The casting side tries to expand, but at the same time this expansion is hindered by the rear side facing the cooling water. This leads to high internal material stresses. If the internal material stresses exceed the elasticity limit of the copper alloy, this leads to a plastic deformation of the casting side, known as bulging. As well as material fatigue, the plastic deformation causes a gap to form between the wide sides and narrow sides of a mould. Liquid steel can penetrate the resulting gap between the narrow side and the wide side of a mould. This may lead to damage to the mould plates during width adjustment. In the least favorable case, the extrusion shell below the mould may tear in the outer corner region of the slab.

It is known to counter a gap formation by means of preventative maintenance by early remachining of the casting surfaces. The reduced wall thicknesses resulting from remachining shorten the remaining service life of the mould. This in turn leads to shorter maintenance intervals and reduced availability of the continuous casting plant.

In order to suppress deformation (bulging) of the mould plates on the casting side, the fastening points of the mould plate to the rear support plates or so-called water chambers are arranged close together and in relatively large numbers. The fastening points arranged close together predefine a specific cooling channel path. Depending on the arrangement of the cooling channels, the heat dissipation—considered over the entire hot side—may have undesirable unevenness. An uneven heat dissipation during casting in turn causes material stresses, in particular in the meniscus region of the mould plate. The material stresses may be so high that plastic deformation occurs. In the extreme case, the copper alloy may even soften. Furthermore, there is a fundamental danger of elastic deformation of the mould plate caused by the temperature gradients between the hot and cold sides of the mould plate.

It is known from DE 10 2016 124 801 B3 to increase the flow rate of the cooling water by inserts in cooling channels. Cooling gaps are thus formed, through which the water can be conducted with high pressure and high flow speed. These inserts, which reduce the local cross-section of the cooling channel, in some cases bridge relatively wide cooling channels. Thus fewer individual inserts are necessary. On the one hand, inserts as large as possible are suitable because this simplifies the rear side of the cooling plate, but on the other hand the risk of bulging increases with very wide cooling channels and correspondingly wide inserts.

It is proposed to connect the inserts to fastening points in the cooling face via clamps or fastening bolts. It is furthermore proposed to avoid hot spots in the regions in which the mould plate is connected to a support plate or water chamber via fastening bolts. For this, at least one cooling channel extends, viewed from a fastening plate towards the support plate or water chamber of the casting side opposite the rear side of the mould plate, up to below the fastening point. In this way, the cooling in the base region of the fastening points may be improved.

JP 2006 320 925 A discloses an additional cooling channel below a fastening point. The fastening point serves to receive a fastening bolt for connecting a mould plate to a support plate. In contrast to DE 10 2016 124 801 B3, the outer adjacent cooling channels are not widened to extend up to below the fastening point, but a further cooling channel is produced below the fastening point. Production is however comparatively complex.

DE 10 2004 001 928 A1 discloses a liquid-cooled mould for continuous casting of metals, wherein the mould plates are connected to a supporting structure by means of fastening bolts. The mould plates or the mould pipe and the supporting structure are connected together without clamping, wherein a working gap is present between the supporting structure and the mould plate or mould pipe. The working gap is situated at the side of the fastening points and in particular at the side of a threaded insert arranged there, which is part of or forms the fastening point.

The invention is based on the object of indicating a mould plate in which the risk of bulging is reduced. Deformations of the mould plate in continuous casting are minimized.

SUMMARY OF THE INVENTION

This object is achieved with a mould plate as set forth hereinafter.

The subclaims concern advantageous refinements of the invention.

The mould plate according to the invention has a casting side and a rear side facing away from the casting side. The mould plate consists of a copper alloy. It may be combined with further specific plates into a mould, as used in continuous casting of metal melts. At least one cooling channel open towards the rear side is located in the rear side. It has a cooling face opposite the casting side, An insert is arranged in the cooling channel in order to form a cooling gap between an inner face of the insert and the cooling face. In casting operation, cooling water is conducted through this cooling gap in order to cool the mould plate via the cooling face and hence also the casting side. The insert is connected to fastening points in the cooling face by means of fastening bolts. The region of the cooling face may also be described as a groove base of a cooling system. The invention does not exclude the presence of further connecting points between the insert and the mould plate. Preferably, the insert is connected to the mould plate exclusively via the fastening points in the cooling face, La within the cooling channel.

Usually, the inserts are not connected to the mould plate in the region of the cooling face, but outside the region of the cooling face. By arranging the fastening points directly on or in the cooling face however, the region between the adjacent walls of the cooling channel is bridged. Fixing points are arranged in the region of the walls of the cooling channel, via which the mould plate can be bolted to a steel supporting plate or to a water chamber. For better distinction, in this invention the points of connection of the mould plate to the support plate are called fixing points, while the points for connection of the insert to the mould plate are called fastening points. In both cases, the connection takes place in the same fashion, namely via fastening bolts or fixing bolts, i.e. via screw connections. In the invention, the fastening bolts may be provided as stud bolts on the mould plate, so that nuts must be screwed onto the fastening bolts. However, conversely, the fastening bolts may have a screw head and be screwed into threaded receivers at the fastening points or fixing points. Mixed combinations of stud bolts and screw bolts are possible.

The essential advantage of the arrangement of the fastening points according to the invention is that the inserts, which in any case rest at the rear on the support plate, are used not only to determine the cross-section of the cooling gap and hence increase the flow speed, but rather contribute to preventing plastic deformations by bulging in the region of the cooling gap. The fastening points or the fastening in the region of the cooling face quite considerably improve(s) the form-stability of the entire mould plate during casting usage, in particular if a plurality of fastening points is provided. Preferably, at least as many fastening points are provided as fixing points. Doubling the number of connecting points (fastening points including fixing points) means that the mould plate is extremely stiffened without the wall thickness of the mould plate to the casting side needing to be increased. In this way, a great quantity of heat can still be dissipated in a very short time, wherein the risk of plastic deformation is reduced, as is the risk of gap formation between the wide and narrow sides of a continuous casting mould. If a small gap or no gap is formed, preventative maintenance is not required or no longer to this extent. Remachining on the casting surface may take place at longer intervals, as required. The service life of the mould as a whole is thereby longer, so the availability of the continuous casting plant is improved.

In a practical embodiment, the fastening points in particular are island-like elevations relative to the cooling face. The cooling face is preferably a substantially flat face. Individual webs may be arranged inside the cooling face, which point towards the inner face of the insert, Individual cooling gaps are formed between these webs or between the cooling face and the inner face, and cooling water flows through these gaps. The fixing points are preferably situated in the region of the webs, so that the respective cooling gap can still run substantially straight. The individual webs in the cooling face preferably also run straight and parallel to one another, i.e. in the longitudinal direction of the respective cooling channel, Preferably, two or three webs are arranged within a cooling channel. Depending on the number of webs, within a cooling channel there are fastening points in the region of each web. The spacing of the fastening points in the transverse direction of the channel therefore corresponds to the spacing of the webs. The spacings in each case relate to the center spacing. Preferably, there are two fastening points spaced apart from one another in the transverse direction.

The island-like elevations in the cooling face furthermore have the advantage that fastening takes place not via engagement in the cooling face but via fastening points on the cooling face. The thickness of the mould plate between the casting side and the cooling face in the region of the fastening points is therefore at least no smaller than in the other regions of this cooling channel. Thus in the region of the fastening points, no material weakening occurs. This again has advantages with respect to force transmission and also advantages with respect to homogenization of heat transmission. The material reserves for remachining of the casting side are retained.

For optimum cooling performance, it is desirable if the thickness of the mould plate below the cooling face does not fluctuate excessively. In particular, as far as possible no hot-spots should occur, i.e. points at which the heat dissipation is reduced. Theoretically, such hot-spots could occur with island-like elevations of very large area, since the cooling water does not reach the core region of an island-like elevation. The heat dissipation below such a fastening point could therefore be reduced. According to the invention, however, it is provided that at least one cooling channel extends, viewed from the fastening point towards the casting side, up to below the fastening point. The fastening point to a certain extent has an undercut. The undercut may be provided on one or both sides. If the fastening point is arranged centrally on a web, the undercut may be configured such that the web runs with the same width and/or height also below the fastening point, while the fastening point itself only begins above the web. In this way, the web below the fastening point is cooled in the same way as outside the fastening point. No hot-spots occur. The heat dissipation remains even and homogenous over the entire length of the web.

The several fastening points are preferably arranged offset to one another not only in the longitudinal direction but also in the transverse direction of the cooling channel. As explained above, they are arranged in particular in alignment in relation to the respective webs. The fastening points of two adjacent webs need not necessarily be arranged in the same length portion. i.e. directly next to one another in the transverse direction. They may in particular be arranged offset to one another in the longitudinal direction. Starting from two webs therefore, an arrangement of fastening points results which increases the number of fastening points not only in the transverse direction but also in the longitudinal direction. The respective fastening points, in particular viewed in the longitudinal direction, are situated at a distance from the fixing points via which the mould plate is attached to the support plate. The fastening points may for example be arranged in a zigzag pattern or trapezoid pattern. The aim is to achieve as even as possible a support of the thin-walled mould plate in the region of the cooling channel. If necessary, for this, individual fastening points may be arranged at same level, i.e. in the same length portion.

In the prior art, the inserts rest on the support plate in the installation position. Therefore, at support protrusions in their edge region, at least in portions, they have a height or thickness which extends over the entire depth of the cooling channel from the rear side of the mould plate up to the cooling face.

In the invention, it is provided that rear support protrusions, which extend up to the rear side of the mould plate, are preferably arranged in the length portion of the cooling channel in which a fastening point is situated. Thus the mould plate can rest directly via the webs or fastening points on the support plate arranged at the rear. If the inserts extend over a web delimiting the cooling channel, or in general a wall of the cooling channel, the insert may absorb tension forces which result from thermal expansion in the casting side. The mould cannot lift away from the insert because of the fastening point in the cooling channel, and the insert in turn cannot move in the direction towards the casting side because it rests on the web or wall. The support protrusions may overlap the webs or wall. They may extend over a region of lower height of the web, or grip in a rear pocket of the mould plate, so that they do not protrude beyond the rear side. In this case, the support protrusions have a double function of absorbing tensile forces and compression forces, and depending on position (front of support plate/rear of web) of the adjacent faces, transmit these to neighboring components (mould plate, support plate).

In particular, mutually directly opposite support protrusions are arranged on the two long sides of an insert, namely at the level of a fastening point. When the fastening points lie very close together, i.e. with fastening points having a small spacing in the longitudinal direction, the support protrusions may merge into one another or a single support protrusion which is correspondingly wider may be provided.

The mutually opposite support protrusions allow forces acting on the fastening points to be conducted from the mould plate into the rear support plate via the insert evenly on the left side and right side of the insert Preferably, the region between two mutually directly opposite support protrusions is formed as a thickened yoke in which one or two fastening bolts are arranged. Therefore, the insert preferably has a greater thickness between the mutually opposite support protrusions on the long sides than in the regions arranged next to the support protrusions in the longitudinal direction. The greater thickness achieves a higher bending stiffness of the insert in the region of the fastening bolts or in the region of the fastening points.

In an advantageous refinement, the connection between the mould plate and the insert is configured such that the expansion of the mould plate due to high thermal influences is not hindered under casting conditions. In a refinement of the invention, this may be achieved in that in the region of a fastening point, a working gap is arranged between the mould plate and the insert. The working gap is very small. It ensures that the mould plate is mounted floating relative to the insert. Here, the fastening point, i.e. the mould plate, can be displaced transversely to the cooling channel, i.e. laterally, in the longitudinal direction and transverse direction of the cooling channel, without seizing. The floating mounting does not mean that the mould plate tends to bulge because of the additional degrees of freedom and is therefore exposed to plastic deformations. It merely prevents the buildup of additional stresses inside the mould plate. Therefore the fastening bolt is located in a sufficiently large through-bore which is so large that the mould plate with fastening bolt arranged thereon can move laterally relative to the insert, but only within limits perpendicularly to the insert. The position of the insert relative to the mould plate is fixedly predefined by the contact on the rear side of the support plate.

In a refinement of the invention, the fastening bolt is screwed to the fastening point with the use of a screw-locking element. In particular, the screw-locking element rests on a sleeve situated between a bolt head and the fastening point. In this case, the fastening bolt with the sleeve and screw-locking element forms a unit with the mould plate, wherein this unit is displaceable laterally relative to the insert.

The through-bore in which the fastening bolt is arranged preferably has a step in the diameter so as to form a contact face for the bolt head or a protruding collar of a sleeve on which the bolt head rests. The contact face in combination with a working gap defines the degree of freedom of the mould plate perpendicularly to the cooling face. Here even a minimal gap is sufficient to allow lateral displacement of the mould plate relative to the insert without increasing the risk of bulging. The width of the working gap is preferably less than 0.2 mm.

Although coolant may penetrate the working gap, the working gap in the sense of the invention is not designed as a coolant channel but has a substantially smaller width. In principle, in the context of the invention, the working gap may be structured differently, and the arrangement and number of fastening points may also be varied so as to achieve as homogenous a cooling and as constant a stiffness of the mould plate as possible.

In the context of the invention, the expression "connection between mould plate and insert without clamping" means that only slight material stresses occur in the copper material of the mould plate if this moves in the longitudinal direction or transverse direction relative to the insert because of thermal influences, A contact with the insert and fastening point with simultaneously small coefficients of friction is not critical, Only clamping and blocking due to high preloads between the insert and mould plate in this region are preferably avoided.

Finally, it is regarded as particularly advantageous if the bolt heads of the fastening bolts are arranged fully countersunk into a stepped through-bore in the insert. The slightly larger thickness of the inserts in the region of the through-bores results from the fact that the support protrusions are arranged on the long side of the insert, and a high torsional stiffness of the insert is ensured between the fastening points and the support protrusions. In this region, the insert functions as a yoke. This does not however mean that particularly long screw bolts must be used. For reasons of material saving, the bolt heads may be arranged completely countersunk into the through-bore.

The through-bore preferably has steps on both sides. Firstly, the bolt head may be countersunk into the through-bore. In the middle region, the through-bore has a contact face in the form of an inwardly directed collar. The island-like elevated fastening point is arranged on the opposite side of the through-bore or collar. The fastening point preferably engages completely in the insert. On the periphery of the fastening point, there is a sufficiently wide gap for the mould plate to be movable laterally to the through-bore.

DETAILED DESCRIPTION OF PREFERRED EMBODIMENTS

Figure 1:
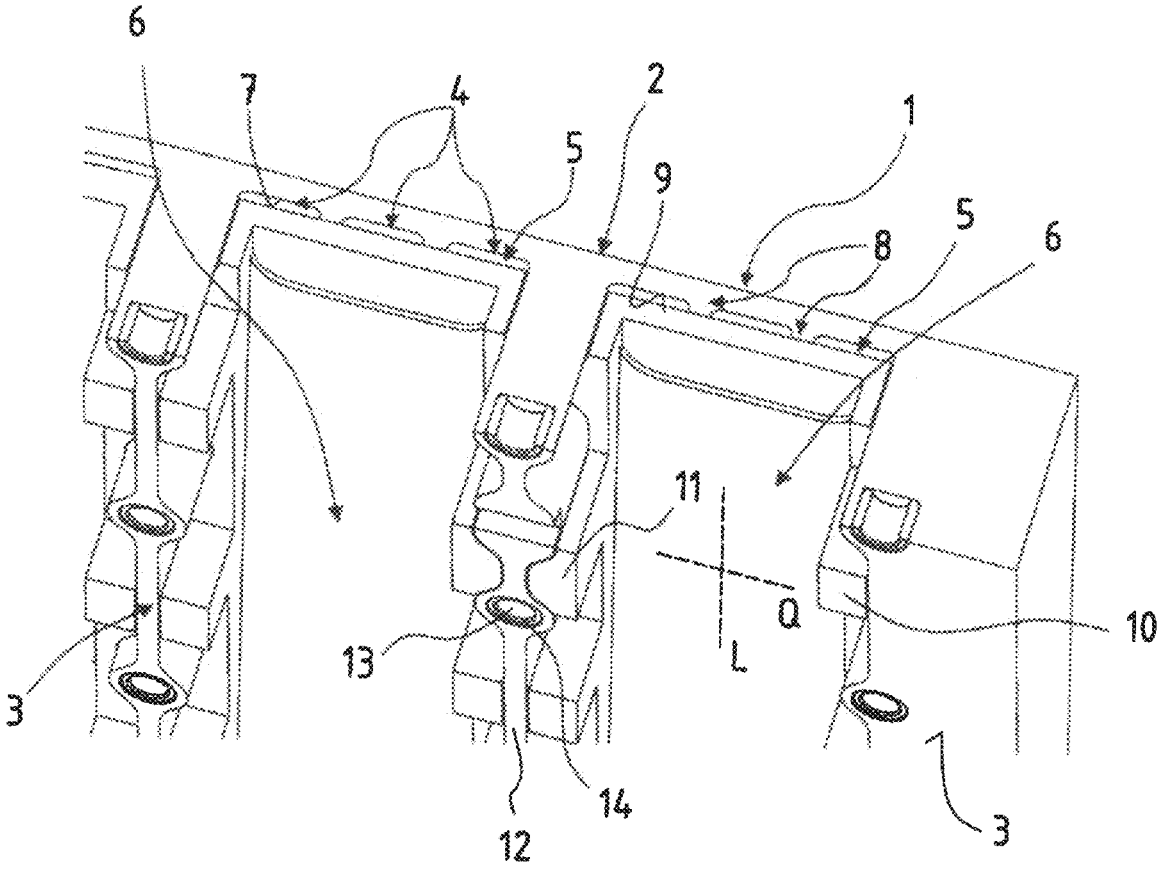
(Prior Art) Fig. 1
FIG. 1 shows a perspective view of a partial region of a mould plate according to the prior art.

FIG. 1 shows the prior art and serves to explain the technological background. It is not an embodiment for which protection is claimed. The invention is then explained in more detail with reference to an exemplary embodiment shown purely schematically in FIG. 2.

Figure 2:
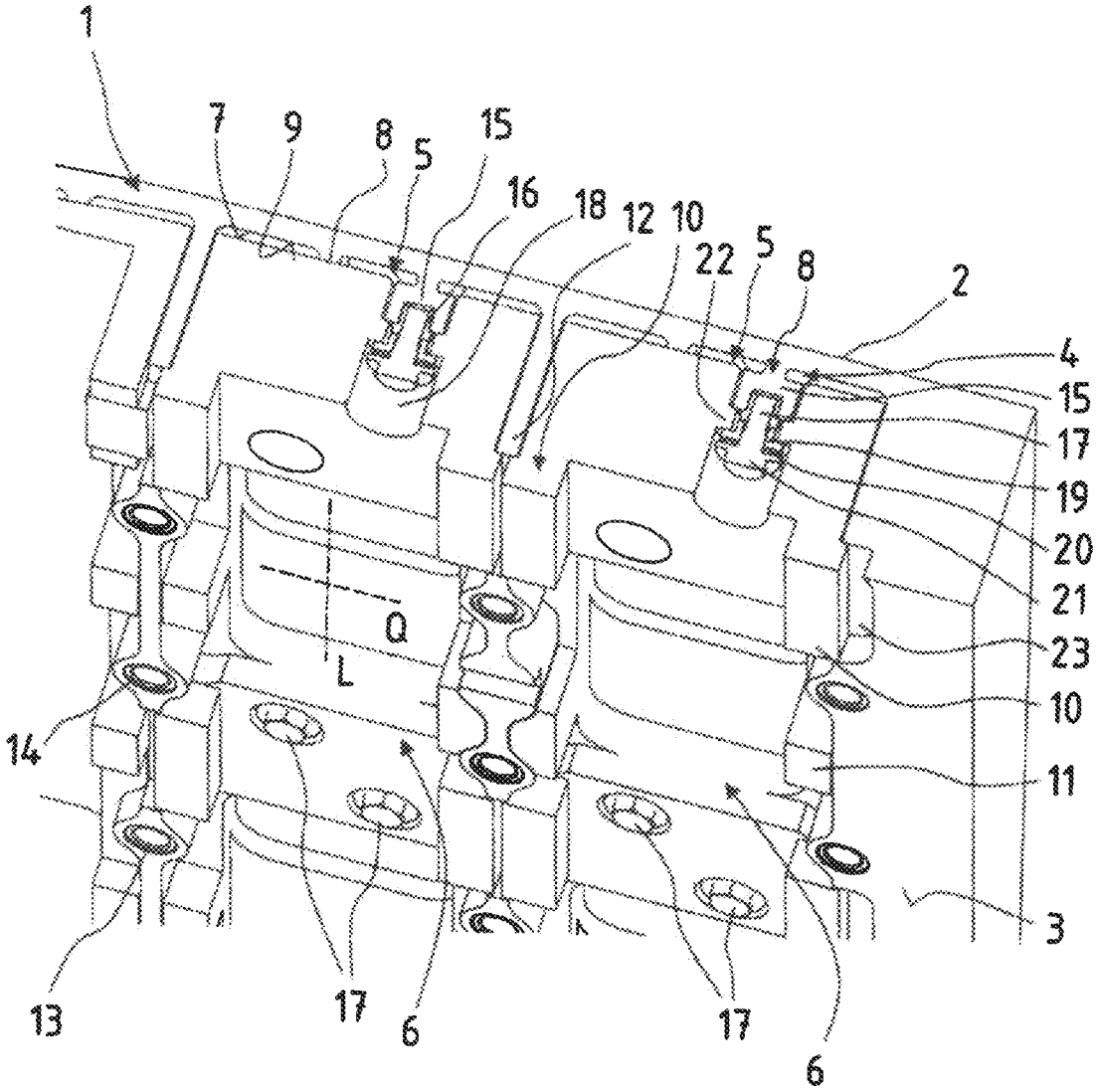
FIG. 2 shows a perspective view of a partial region of a mould plate in partial according to the invention.

FIG. 1 shows in a perspective view a partial region of a mould plate 1 in partial cross-section. The reference signs used to explain the mould plate 1 in FIG. 1 are also used for components of substantially the same function in the mould plate 1 according to the invention as shown in FIG. 2.

The mould plate 1 in FIG. 1 has a casting side facing away from the viewer, and a rear side 2 facing the viewer. In the installation position, the rear side 2 rests on a support plate (not shown in detail). During casting operation, hot melt on the casting side 2 is cooled in that heat is extracted from the mould plate 1 and dissipated via cooling water conducted through cooling gaps 4, which in turn are situated inside cooling channels 5. The casting direction for this mould plate 1 corresponds to the vertical direction. The cooling channels 5 therefore extend parallel to the casting direction from top to bottom. They run parallel to one another.

Inserts 6 which delimit the cooling gap 4 towards the rear side 3 are arranged inside the cooling channels 5. The inserts 6 are formed U-shaped in cross-section, Their inner faces 7 facing the cooling gaps 4 bear on webs 8, which point from a cooling face 9 of the cooling channels 5 in the direction towards the rear side 3 of the mould plate 1. The webs 8 determine the height of the cooling gaps 4, The mutual spacing of the webs 8 determines the width of the cooling gaps 4, and hence as a whole the cross-sectional area of the cooling gaps 4. During casting operation, a high pressure prevails in the cooling gaps 4. During operation therefore, the inserts 6 rest on a support plate which is not shown in detail. For this, they have several support protrusions 10 which are arranged spaced apart from one another and reach as far as the rear side 3 of the mould plate 1. The inserts 6 are contoured on their long sides and have support protrusions 11 that are profiled towards the long side so as to be adapted to the contour of the walls of the cooling channels 5, such that the inserts 6 are positionally oriented inside the cooling channels 5 both in the longitudinal direction L and in the transverse direction Q. The inserts 6 can only be removed from the cooling channels 5 towards the rear 3.

Two adjacent cooling channels 5 are separated from one another by webs 12. Fixing points 13 which are spaced apart from one another are arranged within the webs twelve. They have threaded inserts 14 via which the mould plate 1 together with the inserts 6 can be bolted to the support plate to be arranged on the rear. In this way, each insert 6 is precisely positionally oriented and held inside the cooling channels.

The mould plate 1 according to the invention has the essential difference that fastening points 15 with threaded inserts 16 are arranged on the respective cooling faces 9 of the cooling channels 5. The fastening points 15 point towards the rear side 3 of the mould plate 1. Fastening bolts 17 are arranged hi through-bores 18 in the respective insert 6, and screwed into the threaded inserts 16 of the fastening points 15, Via a sleeve 19 and the screw-locking element 20, the bolt head 21 of the fastening bolt 17 bears on the fastening point 15. A collar 22 in the through-bore 18 is held with play between the fastening point 15 and the sleeve 19. In a manner not depicted in detail, a narrow working gap with a width of less than 2/10 mm is situated between the fastening point and the sleeve 19. Also, the diameter of the through-bore 18 in its entire length region is so large that a slight lateral shift of the fastening point 15 relative to the insert 6 can take place. In this way, thermally induced stresses between the insert 6 and mould plate 1 are avoided.

The fastening points 15 are each situated in the region of the webs 8. Since two webs 8 have a parallel distance from one another, there are two rows of fastening points 15. The fastening points 15 of the adjacent rows are arranged offset to each other in the longitudinal direction L of the cooling channel 5. Since the webs 8 which delimit the cooling gaps 4 are arranged at approximately equal distances from one another, the respective fastening points 15 have approximately the same distance from a left and a right wall of the respective channel 5, and therefore have approximately the same distance from the fixing points 13 arranged there. This gives a high density of fastening points 15 and fixing points 13, via which the mould plate 1 may be connected to the inserts 6 and a support plate respectively.

The fastening points 15 are island-like elevations. They start at a distance from the cooling face 17, i.e. where the webs 8 end. Since the fastening points 15 have a greater width than the webs 8, the fastening points 15 have an undercut towards the casting side when viewed vertically from the rear. The adjacent cooling gap 4 extends to below the respective fastening point 15, but only so far as defined by the width of the web 18. In the sectional depiction of FIG. 2, the fastening points 15 appear to be constricted at the side. These constrictions below the fastening points 15 therefore take the form of segments lying diametrically opposite one another and separated by the web. The web 8 to a certain extent is the connecting link between the fastening point 15 and the cooling face S.

The through-bores 18 are situated between two diametrically opposed support protrusions 10 which are each arranged on a respective long side of the insert 6. There are further support protrusions 11 at a distance from the above-mentioned support protrusions 10. The support protrusions 10, 11, as in the embodiment of the prior art, serve to support the inserts 6 at the rear on the support plate (not shown in detail). The wider support protrusions 11 are situated where the respective insert 6 has a greater thickness than the regions of the insert 6 adjacent thereto in the longitudinal direction L. The other regions are those length portions in which there are no fastening points 15 or through-bores 18. The thicker regions between the mutually opposite, wider support protrusions 10 serve as yokes and are therefore intended to absorb forces exerted by the mould plate 1 on the inserts 6 in the region of the cooling face 9 and via the fastening points 15. The regions between said support protrusions 10 are particularly bend-resistant and solid. In the other regions in which the inserts 6 merely have the function of delimiting the cooling gaps 4, but without absorbing forces via additional fastening points 15, no such solid supports are required. Accordingly, the support protrusions 11 there are dimensioned smaller in cross-section.

The inserts 6 may not only absorb forces acting from the webs 8 on the cooling face 9 in the direction of the inserts 6 and transmit these to the support plate, but also absorb forces which point in the opposite direction. For this, the support protrusions 10 extend over the web 12 between two cooling channels 5. In this region, the insert 6 is wider than the cooling channel 5. In this region, the web 12 has a slightly smaller height. As a result, the support protrusion 10 does not protrude beyond the rear side 3 but ends in the same plane as the fixing points 13 and the other regions of the web 12, If no web is present, as at an end-side cooling channel 5, the support protrusion 10 grips in a rear pocket 23 which is a depression in the rear side 3. The support protrusion 10 does not therefore protrude beyond the rear side 3.

It is furthermore noted that the bolt heads 21 of the fastening bolts 17 are completely countersunk into the stepped through-bores 18 of the insert 6.

The mould plate 1 according to the invention, because of the plurality of fastening points 15 between the inserts 6, has a higher bending stiffness so as to avoid plastic deformations due to thermal influences. In comparison with the prior art, the homogeneity of the heat dissipation is retained.

The invention claimed is:

1. A mould plate, comprising:

a casting side;

a rear side facing away from the casting side and having a cooling channel configured to open towards the rear side and having a cooling face opposite the casting side;

an insert arranged in the cooling channel such as to form a cooling gap between an inner face of the insert and the cooling face; and a fastening bolt connecting the insert to a fastening point in the cooling face, wherein the cooling gap extends, viewed from the fastening point towards the casting side, to an area below the fastening point.

2. The mould plate of claim 1, wherein the fastening point is configured as an island elevation relative to the cooling face.

3. The mould plate of claim 2, wherein a thickness of the mould plate between the casting side and the cooling face in a region of the fastening point is no smaller than in other regions of the cooling channel.

4. The mould plate of claim 1, wherein the cooling face includes a plurality of said fastening point which are arranged offset to one another in a longitudinal direction and in a transverse direction of the cooling channel.

5. The mould plate of claim 1, wherein the insert includes a rear support protrusion in a length portion of the fastening point with respect to a longitudinal direction of the cooling channel.

6. The mould plate of claim 1, wherein the insert includes mutually directly opposite support protrusions on two long skies of the insert.

7. The mould plate of claim 6, wherein the insert has between the mutually opposite support protrusions on the long sides a thickness which is greater than a thickness next to the support protrusions in a longitudinal direction.

8. The mould plate of claim 1, wherein a working gap is arranged between the mould plate and the insert in a region of the fastening point so as to mount the mould plate floatingly relative to the insert at the fastening point, with the fastening point being displaceable relative to the insert laterally in a longitudinal direction and a transverse direction of the cooling channel without seizing.

9. The mould plate of claim 8, wherein the working gap is less than 2/10 mm.

10. The mould plate of claim 1, further comprising a screw-locking element configured to screw the insert to the fastening point.

11. The mould plate of claim 1, wherein the fastening point has a threaded insert.

12. The mould plate of claim 1, wherein the fastening bolt includes a bolt head which is arranged fully countersunk into a stepped through-bore in the insert.

13. The mould plate of claim 1, wherein the insert extends over a web delimiting the cooling channel and/or grips in a rear pocket in a wall of a cooling channel.

* * * * *